US007086836B1

(12) United States Patent
Sheth et al.

(10) Patent No.: US 7,086,836 B1
(45) Date of Patent: Aug. 8, 2006

(54) DUAL RATE TORQUE TRANSMITTING DEVICE FOR A MARINE PROPELLER

(75) Inventors: Mitesh B. Sheth, Fond du Lac, WI (US); Michael P. Mihelich, Fond du Lac, WI (US); John A. Tuchscherer, Oshkosh, WI (US); Roger E. Koepsel, Oshkosh, WI (US); Daniel J. Schlagenhaft, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 147 days.

(21) Appl. No.: 10/932,776

(22) Filed: Sep. 2, 2004

(51) Int. Cl.
*B63H 23/34* (2006.01)

(52) U.S. Cl. ..... 416/134 R; 416/170 R

(58) Field of Classification Search ..... 416/93 A, 416/134 R, 135, 170 R; 415/124.2; 464/69, 464/73

See application file for complete search history.

(56) References Cited

U.S. PATENT DOCUMENTS

| | | | | |
|---|---|---|---|---|
| 4,566,855 | A | 1/1986 | Costabile et al. | 416/134 R |
| 4,900,281 | A | 2/1990 | McCormick | 440/78 |
| 5,244,348 | A | 9/1993 | Karls et al. | 416/204 R |
| 5,252,028 | A | 10/1993 | LoBosco et al. | 416/93 A |
| 5,322,416 | A | 6/1994 | Karls et al. | 416/204 R |
| 5,908,284 | A | 6/1999 | Lin | 416/134 R |
| 6,383,042 | B1 | 5/2002 | Neisen | 440/49 |
| 6,478,543 | B1 | 11/2002 | Tuchscherer et al. | 416/134 R |
| 6,672,834 | B1 | 1/2004 | Chen | 416/2 |
| 6,773,232 | B1 * | 8/2004 | Powers | 416/134 R |

* cited by examiner

*Primary Examiner*—Ninh H. Nguyen
(74) *Attorney, Agent, or Firm*—William D. Lanyi

(57) ABSTRACT

A torque transfer mechanism for a marine propulsion system provides a connector mechanism, a first torque transfer mechanism, and a second torque transfer mechanism. A plurality of rods can provide the first torque transfer mechanism and a polymer component is shaped to provide the second torque transfer mechanism. All torque below a preselected magnitude is transferred through the first torque transfer mechanism and, for magnitudes of torque above the threshold, torque is transferred by both the first and second torque transfer mechanisms. The connector mechanism has an outer surface that is not used to transfer torque between it and an inner hub of a propulsor.

33 Claims, 7 Drawing Sheets

DUAL RATE TORQUE TRANSMITTING DEVICE FOR A MARINE PROPELLER

BACKGROUND OF THE INVENTION

1. Field of the Invention

The present invention is generally related to a marine propeller and, more particularly, to a dual rate torque transmitting device which reduces noise at low torque magnitudes while maintaining the capacity to transmit higher torque magnitudes.

2. Description of the Prior Art

Those skilled in the art of marine propellers are familiar with various devices which have been provided to attach a propeller to a propeller shaft in a way which provides a certain degree of resilience in the torque transmitting connection.

U.S. Pat. No. 4,566,855, which issued to Costabile et al. on Jan. 28, 1986, describes a shock absorbing clutch assembly for a marine propeller. The propeller hub has an axial hole therein having a wavy, non-cylindrical surface consisting of a plurality of alternating peaks and valleys. A closely fitting resilient insert slips into the axial hub hole of the propeller hub and has an outer surface with peaks that extend into the respective valleys of the axial hub hole. The resilient insert has a cylindrical axis hole therein with a plurality of longitudinal keyways disposed in the surface of that hole.

U.S. Pat. No. 4,900,281, which issued to McCormick on Feb. 13, 1990, discloses a marine drive with an improved propeller mounting. The marine drive is intended for use with a boat and includes a longitudinally extending propeller shaft which effectively carries the propeller hub between a pair of fore and aft conical surfaces which mate with similar conical surfaces associated with the hub. These mating surfaces prevent orbiting movement of the propeller. The mating surfaces also center the hub on its axis and provide for high torque retention.

U.S. Pat. No. 5,252,028, which issued to LoBosco et al. on Oct. 12, 1993, describes a marine propeller assembly with shock absorbing hub and easily replaceable propeller housing. A shock absorbing hub for a marine propeller assembly includes an inner spindle telescoped into the splined drive shaft of the engine, an outer sleeve spaced radially outwardly of the spindle, and a molded-in-place core of elastomeric material filling the space between the spindle and the sleeve to transmit torque between the two while cushioning torsional shock.

U.S. Pat. No. 5,322,416, which issued to Karls et al. on Jun. 21, 1994, discloses a torsionally twisting propeller drive sleeve. The drive sleeve is disposed between a propeller shaft and a propeller hub in a marine drive and absorbs shock after the propeller strikes an object by torsionally twisting between a forward end keyed to the propeller hub and a rearward end keyed to the propeller shaft. The drive sleeve is composed of a plastic material providing torsional twisting angular rotation at a first spring rate less than 100 lb. ft. per degree from 0 degrees to 5 degrees rotation, a second higher spring rate beyond 5 degrees rotation, and supporting over 1,000 lb. ft. torque before failure.

U.S. Pat. No. 5,908,284, which issued to Lin on Jun. 1, 1999, describes a marine propeller with a tube shape shock absorbing means. The propeller is made up of a propelling unit having a plurality of blades, a driving unit for driving the propelling unit, and a plurality of deformable transmission units located between the propelling unit and the driving unit such that the transmission units are retained in the retaining slots of the propeller unit and the drive unit.

U.S. Pat. No. 6,383,042, which issued to Neisen on May 7, 2002, describes an axial twist propeller hub. A propeller assembly that includes an interchangeable drive sleeve, a resilient interhub having a bore in which the drive sleeve is inserted, and a propeller including an outer hub in which the drive sleeve and resilient inner hub are inserted, is described. In an exemplary embodiment, the drive sleeve includes a cylindrical shaped body and a plurality of splines extend from an outer diameter surface of the drive sleeve body. A bore extends through the drive sleeve and a plurality of grooves are in an inner diameter surface of the drive sleeve bore.

U.S. Pat. No. 5,244,348, which issued to Karls et al. on Sep. 14, 1993, discloses a propeller drive sleeve. A shock absorbing drive sleeve is provided by a molded plastic member directly mounting the propeller hub to the propeller shaft. The sleeve has a rearward inner diameter portion engaging the propeller shaft in splined relation and a forward inner diameter portion spaced radially outwardly of and disengaged from the propeller shaft. The drive sleeve has a rearward outer diameter portion and a forward outer diameter portion engaging the propeller hub.

U.S. Pat. No. 6,478,543, which issued to Tuchscherer et al. on Nov. 12, 2002, discloses a torque transmitting device for mounting a propeller to a propeller shaft of a marine propulsion system. The device is intended for use in conjunction with a marine propulsion system and provides an adapter that is attached in torque transmitting relation with a propulsor shaft for rotation about a central axis of rotation. The first insert portion is attached in torque transmitting relation with the adapter and a second insert portion is attached in torque transmitting relation with a hub of the propeller hub which can be a marine propeller or an impeller. A third insert portion is connected between the first and second insert portions and is resilient in order to allow the first and second insert portions to rotate relative to each other about the central axis of rotation.

U.S. Pat. No. 6,672,834, which issued to Chen on Jan. 6, 2004, describes a removable propeller assembly incorporating breakaway elements. A propeller assembly is provided for mounting on a rotatable propeller shaft of a marine vehicle. The propeller assembly includes a central adapter mounted on the propeller shaft for rotational movement therewith. A tubular propeller housing is slidable over the central adapter. A bushing assembly translates rotation of the central adapter to the propeller housing. A breakaway element is provided for interconnecting in a central adapter and the bushing assembly. The breakaway allows the central adapter to rotate independently of the propeller housing in response to the predetermined force thereon.

The patents described above are hereby expressly incorporated by reference in the description of the present invention.

Attachment devices for connecting a propeller to a propeller shaft of a marine vessel are typically intended to perform several functions. One function relates to the provision of a frangible disconnecting system, such as a fuse, which allows the propeller and propeller shaft to be disconnected from each other in the event that the propeller strikes an object during use. At one time, this function was performed by a shear pin. Now, various types of frangible components can be used for this purpose. A second intended function of many types of torque transfer mechanisms used in marine propeller applications is to permit a preselected degree of relative rotation between the propeller shaft and the propeller hub. A third function that has been provided by certain types of torque transmitting devices used in conjunction with marine propellers is to provide a dual rate torque transmitting connection between the propeller shaft and the propeller hub. During transmission of low magnitudes of torque, rapid accelerations and decelerations of the propeller shaft, relative to the propeller hub, can result in a condition referred to as "propeller rattle". This phenomenon can be caused by the individual power strokes of numerous cylinders of an engine. It is compounded by various interconnections in a drive train of a marine vessel that can allow intermittent contact and separation between driving and driven elements of the drive system. A marine torque transmitting device used in conjunction with a propeller system must also be capable of transmitting higher magnitudes of torque when the marine vessel is operating at its maximum load and thrust capabilities.

It would therefore be significantly beneficial if a torque transmitting device for a marine propeller could be provided which is sufficiently resilient at low torque magnitudes to reduce the degree of propeller rattle while being sufficiently rigid at higher torque magnitudes to be able to satisfactorily transmit high magnitudes of torque from a propeller shaft to a propeller hub.

SUMMARY OF THE INVENTION

A torque transmitting device for a marine propulsion system made in accordance with a preferred embodiment of the present invention comprises an adaptor, a connector mechanism, a first torque transfer mechanism, and a second torque transfer mechanism. The adapter can be shaped to be attached in torque transmitting relation with a propulsor shaft of the marine propulsion system for rotation about an axis of the propulsor shaft. The connector mechanism can be attached in torque transmitting relation with the adaptor for rotation in synchrony with the adapter about the axis. The first torque transfer mechanism can have a first end and a second end. The first end of the first torque transfer mechanism can be attached to the connector for rotation in synchrony with the connector about the axis. The second torque transfer mechanism can be rotatable relative to the adapter by a preselected angular magnitude. The second end of the first torque transfer mechanism can be attached to the second torque transfer mechanism. The second torque transfer mechanism is attachable to a propulsor, such as a marine propeller, for rotation in synchrony with the propulsor about the axis of the propulsor shaft. A radially outer surface of the connector can be disposed generally in non torque transmitting relation with the propulsor. Below a first predetermined magnitude of torque, all torque transferred between the propulsor shaft and the propulsor is transmitted through the first torque transfer mechanism.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
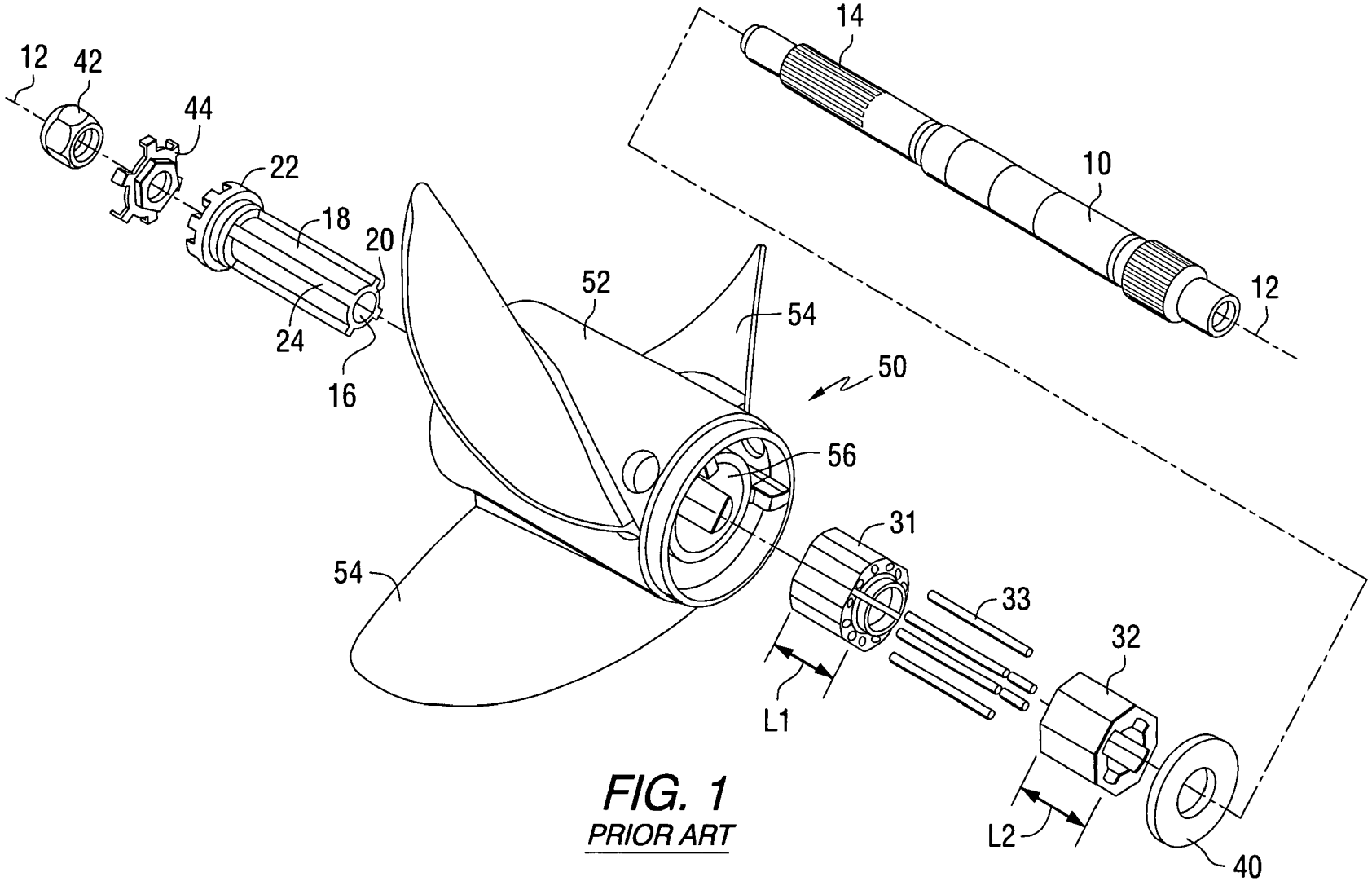
FIG. 1 PRIOR ART
FIG. 1 is an isometric exploded view of a torque transfer mechanism for a marine propulsion system that is generally known to those skilled in the art.

Throughout the description of the preferred embodiment of the present invention, like components will be identified by like reference numerals.

Figure one is an isometric exploded view of a torque transmitting device such as the one described in detail in U.S. Pat. No. 6,478,543. Although the preferred embodiment of the present invention transfers torque in a significantly different way than the system shown in FIG. 1 and described in U.S. Pat. No. 6,478,543, some of the individual components used in that known torque transfer system are generally similar to those used in a preferred embodiment of the present invention. Therefore, it is helpful to understand the structure and operation of the torque transmitting system shown in FIG. 1 in order to more fully appreciate the differences and advantages that are provided by a preferred embodiment of the present invention.

In FIG. 1, a propulsor shaft 10 is supported for rotation about an axis 12. The propulsor shaft 10 is driven, through a gear train and drive shaft assembly, in a manner that is generally known to those skilled in the art. The propulsor shaft 10 is provided with a set of splines 14 which are shaped to be received in meshing relation with a set of splines disposed within the inner cavity 16 of the adapter 18. The adapter 18 has a fore end 20 and an aft end 22. The adapter also is provided with a set of protrusions 24 which extend axially along its outer surface. When assembled, as indicated in FIG. 1, the adapter is attached to the propulsor shaft 10 by the splines. The protrusions 24 connect the adapter 18 to first and second insert portions, 31 and 32. A plurality of rods 33 are connected between the first and second insert portions. The first and second insert portions, 31 and 32, have axial lengths which are identified as L1 and L2 in FIG. 1. As described in detail in U.S. Pat. No. 6,478,543, the first and second insert portions, 31 and 32, are provided with internal grooves that are shaped to receive the protrusions 24 of the adapter 18.

With continued reference to FIG. 1, a washer 40, a nut 42, and a locking device 44 are used to connect the assembly shown in FIG. 1 together as a torque transmitting device. A propulsor 50, such as a marine propeller, is provided with an outer hub 52 to which a plurality of propeller blades 54 are attached. An inner hub 56 is supported coaxially with the outer hub 52 for rotation about the propulsor shaft axis 12. An inner surface of the inner hub 56 is shaped to receive the first and second insert portions, 31 and 32.

Although the torque transmitting system shown in FIG. 1 works well in many applications of propellers 50, certain marine propulsion systems require an increased torque transmitting capability, at high torque demand levels, along with improved inhibition of propeller rattle at lower torque transmitting levels. The primary function of a preferred embodiment of the present invention, as will be described below, is to provide the necessary changes and improvements to the system shown in FIG. 1 so that the torque transmitting device is both effective in minimizing propeller rattle at low torque transfer magnitudes and capable of withstanding higher torque magnitudes without failure or degradation of the torque transmitting components.

Figure 2:
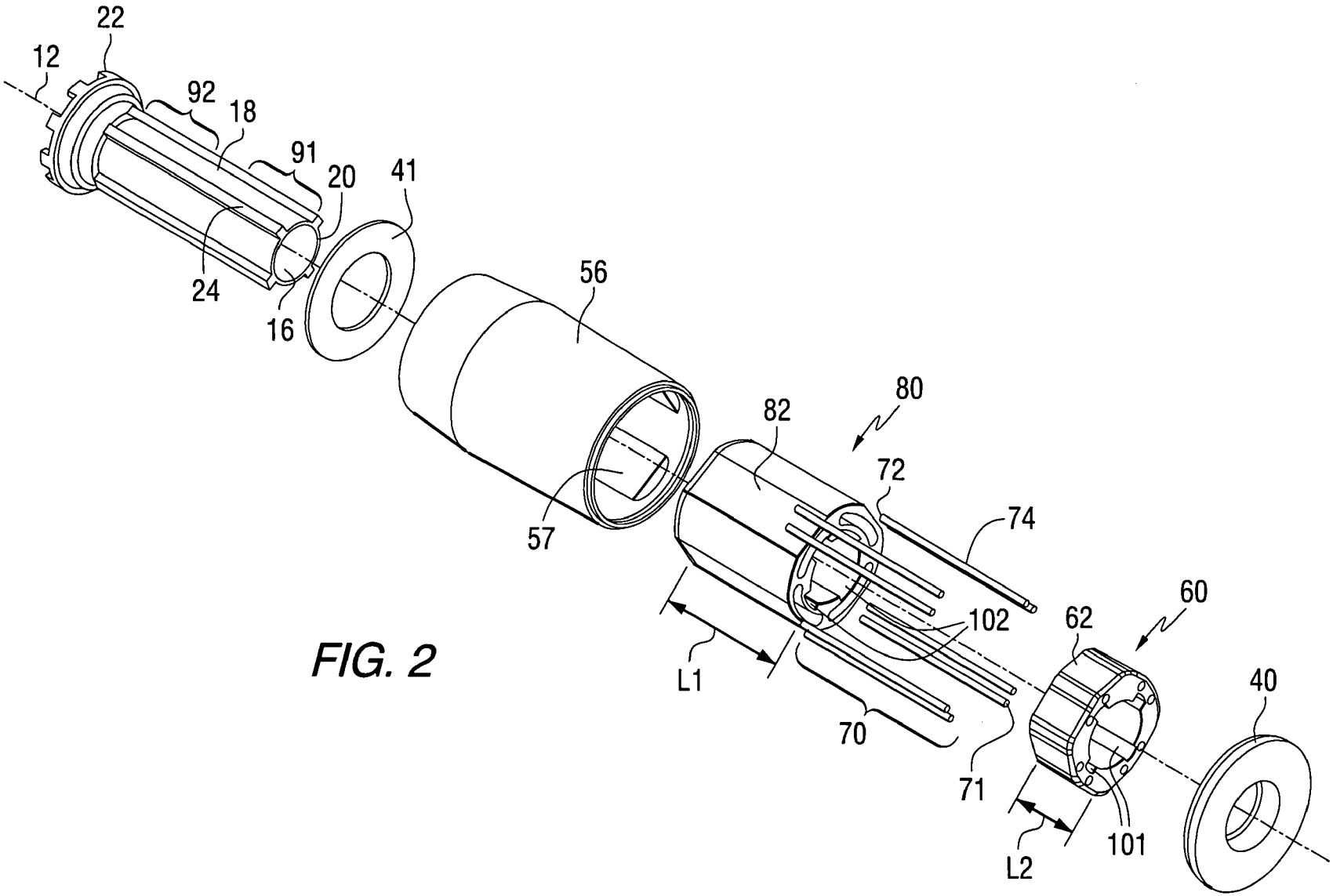
FIG. 2 is an isometric exploded view of a preferred embodiment of the present invention.

FIG. 2 is an isometric exploded view of a torque transmitting device for a marine propulsion system made in accordance with a preferred embodiment of the present invention. An adaptor 18 is shaped to be attached in torque transmitting relation with a propulsor shaft 10, which is not shown in FIG. 2 but has been described above in conjunction with FIG. 1. The adaptor 18 rotates with the propulsor shaft 10 about an axis 12 of the propulsor shaft. A connector mechanism 60 is attached in torque transmitting relation with the adaptor 18 for rotation in synchrony with the adaptor 18 about the axis 12. A first torque transfer mechanism 70 has a first end 71 and a second end 72. The first end 71 of the first torque transfer mechanism 70 is attached to the connector mechanism 60 for rotation in synchrony with the connector 60 about the axis 12.

A second torque transfer mechanism 80 is rotatable relative to the adapter 18 by a preselected angular magnitude. As will be described in greater detail below, this relative rotatability is achieved by providing grooves in the second torque transfer mechanism 80 which are shaped to receive the protrusions 24 in clearance relation therein. The second end 72 of the first torque transfer mechanism 70 is attached to the second torque transfer mechanism 80. The second torque transfer mechanism 80 is attachable to a propulsor, such as the propulsor 50 described above in conjunction with FIG. 1, for rotation in synchrony with the propulsor 50 about the axis 12. A radially outer surface 62 of the connector mechanism 60 is disposed generally in non torque transmitting relation with the propulsor 50 and, more specifically, in non torque transmitting relation with an inner surface of the inner hub 56 which is illustrated without the propulsor 50 in FIG. 2.

The adapter 18 has a first set of spline teeth, which are located in its inner cylindrical opening 16. This first set of spline teeth is shaped to be disposed in meshing relation with a second set of spline teeth 14 of the propulsor shaft, as illustrated in FIG. 1, to attach the adapter 18 in torque transmitting relation with the propulsor shaft 10. In FIG. 2, reference numerals 91 and 92 are intended to show the approximate locations of the portions of the protrusions 24 which are intended to be disposed within the connector mechanism 60 and the second torque transfer mechanism 80, respectively, when the individual elements of the structure in FIG. 2 are assembled. The precise lengths and positions of the first and second plurality of projections are defined by their positions with respect to these other components and can not be precisely identified on the adapter 18 in an exploded view such as FIG. 2. A first plurality of protrusions 91 extends radially outwardly from the adapter 18 and a first plurality of grooves 101 is formed in the connector mechanism 60. Each of the first plurality of grooves 101 is shaped to receive an associated one of the first plurality of protrusions 91 in torque transmitting relation therein. A second plurality of protrusions 92 extends radially outwardly from the adapter 18 and a second plurality of grooves 102 is formed in the second torque transfer mechanism 80. Each of the second plurality of grooves 102 is shaped to receive an associated one of the second plurality of protrusions 92 with a clearance therebetween to permit relative rotation between the adapter 18 and the second torque transfer mechanism 80 about axis 12. In a particularly preferred embodiment of the present invention, as shown in FIG. 2, the first and second pluralities of protrusions, 91 and 92, are aligned with each other and, furthermore, each of the second plurality of protrusions 92 is contiguous with an associated one of the first plurality of protrusions 91, as illustrated in FIG. 2.

With continued reference to FIG. 2, it should be understood that each of the second plurality of grooves 102, which are formed in the second torque transfer mechanism 80, can be shorter than the first axial length L1 of the second torque transfer mechanism 80. In certain embodiments of the present invention, the material selected for manufacture of the second torque transfer mechanism 80 may be stronger than necessary for adequate transfer of torque under normal circumstances. In the event that the propulsor 50 strikes a submerged object, this increased strength of the second torque transfer mechanism 80 may interfere with the characteristic of frangibility that is desirable to avoid damage to the drive train of the marine propulsion system. Therefore, it is beneficial to have the second torque transfer mechanism 80 fail under these circumstances to avoid damage to the drive train. This designed frangibility can be achieved by shortening the axial length of the material between the second plurality of grooves 102 to a length which is significantly less than the overall length L1 of the second torque transfer mechanism 80.

The first torque transfer mechanism 70, which comprises a plurality of rods 74 in a particularly preferred embodiment of the present invention, has a first characteristic of compliance in response to a force exerted on the first torque transfer mechanism 70 as a result of torque exerted between the propulsor shaft 10 and the propulsor 50. The second torque transfer mechanism 80 has a second characteristic of compliance in response to force exerted on the second torque transfer mechanism 80 as a result of torque exerted between the propulsor shaft 10 and the propulsor 50. The use of a plurality of rods, such as those identified by reference numeral 74 in FIG. 2, as a compliant torque transfer device, is known to those skilled in the art. This type of torque transfer device is described and illustrated with significant specificity in conjunction with FIGS. 2, 6A and 6B of U.S. Pat. No. 6,478,543. Also, the shape of the openings formed in the associated components, such as the first and second insert portions, 31 and 32, described above in conjunction with FIG. 1, is known to those skilled in the art and described in detail in U.S. Pat. No. 6,478,543. Therefore, the nature of the torque transfer performed by these rods, identified by reference numeral 33 in FIG. 1 and reference numeral 74 in FIG. 2, will not be described in detail herein. The first characteristic of compliance, of the first torque transfer mechanism 70, is more compliant than the second characteristic of compliance of the second torque transfer mechanism 80. In a preferred embodiment of the present invention, the rods 74 can be metallic and, in a particularly preferred embodiment, can be made of titanium. The diameter of the rods 74 can be selected as one parameter which affects the compliance characteristic of the first torque transfer mechanism 70. The second torque transfer mechanism 80, in a particularly preferred embodiment of the present invention, can be made of a polymer, such as polyetheretherketone (PEEK), and, in one particularly preferred embodiment, can be made of polyetheretherketone that is provided with 30% carbon reinforced fibers suspended in a polyetheretherketone matrix.

With continued reference to FIG. 2, the connector mechanism 60 has an outer surface 62 and the second torque transfer mechanism 80 has an outer surface 82. As will be described in greater detail below, the outer surface 82 of the second torque transfer mechanism 80 is shaped to be received within an internal cavity of the inner hub 56 and in contact with an inner surface 57 of the inner hub 56 in torque transferring relation therewith and with little or no relative rotational movement therebetween. In a particularly preferred embodiment, the shape and size of the outer surface 82 of the second torque transmitting mechanism 80 is selected to conform closely with the size and shape of the inner surface 57 of the inner hub 56 so that torque can be transferred consistently between the second torque transfer mechanism 80 and the propulsor 50. The outer surface 62 of the connector mechanism 60, on the other hand, is not shaped to transfer torque directly from the connector mechanism 60 to the surface 57 of the inner hub 56 directly through the outer surface 62. Although, in certain embodiments of the present invention, a slight amount of torque may be transferred through the outer surface 62 of the connector mechanism 60, because of incidental physical contact between the outer surface 62 and surface 57 of the inner hub 56, this is not an intentional feature of the present invention. In a preferred embodiment of the present invention, the outer surface 62 can actually be disposed in noncontact association with surface 57 of the inner hub 56.

With continued reference to FIG. 2, the preferred embodiment of the present invention is intended to transfer torque from an adapter 18 to the connector mechanism 60 through direct contact between the first plurality of protrusions 91 and the first plurality of grooves 101 which are shaped to transfer torque directly and with little or no relative movement between the first plurality of protrusions 91 and the first plurality of grooves 101. When the torque between the propulsor shaft 10 and the propulsor 50 is below a first predetermined magnitude, such as fifteen foot pounds, all of the torque is transferred through the first torque transfer mechanism 70 to the second torque transfer mechanism 82. That torque is transferred through the outer surface 82 of the second torque transfer mechanism 80 to the inner surface 57 of the inner hub 56. At torque magnitudes below the preselected threshold, virtually all torque is transferred from the propulsor shaft 10 to the inner hub 56 through the first torque transfer mechanism 70. The compliance provided by the plurality of rods 74 significantly reduces propeller rattle and the inherent potential damage and noise associated with it. When the torque is below the preselected threshold magnitude, the second plurality of protrusions 92 are disposed within the second plurality of grooves 102, but not necessarily in contact with the sides of those grooves. When the torque increases to a magnitude above the preselected threshold, the second plurality of protrusions 92 moves rotatably relative to the second torque transfer mechanism 80 and into contact with a side surface of the second plurality of grooves 102. This initiates a transfer of torque directly between the adapter 18 and the second torque transfer mechanism 80. Above the preselected threshold, torque is then transferred in parallel by both the combination of the connector mechanism 60 and first torque transfer mechanism 70 and the combination of the adapter 18 and second torque transfer mechanism 80 through the relationship between the second plurality of protrusions 92 and the second plurality of grooves 102. However, a significantly higher magnitude of torque is transmitted through the second torque transfer mechanism 80.

Figure 3:
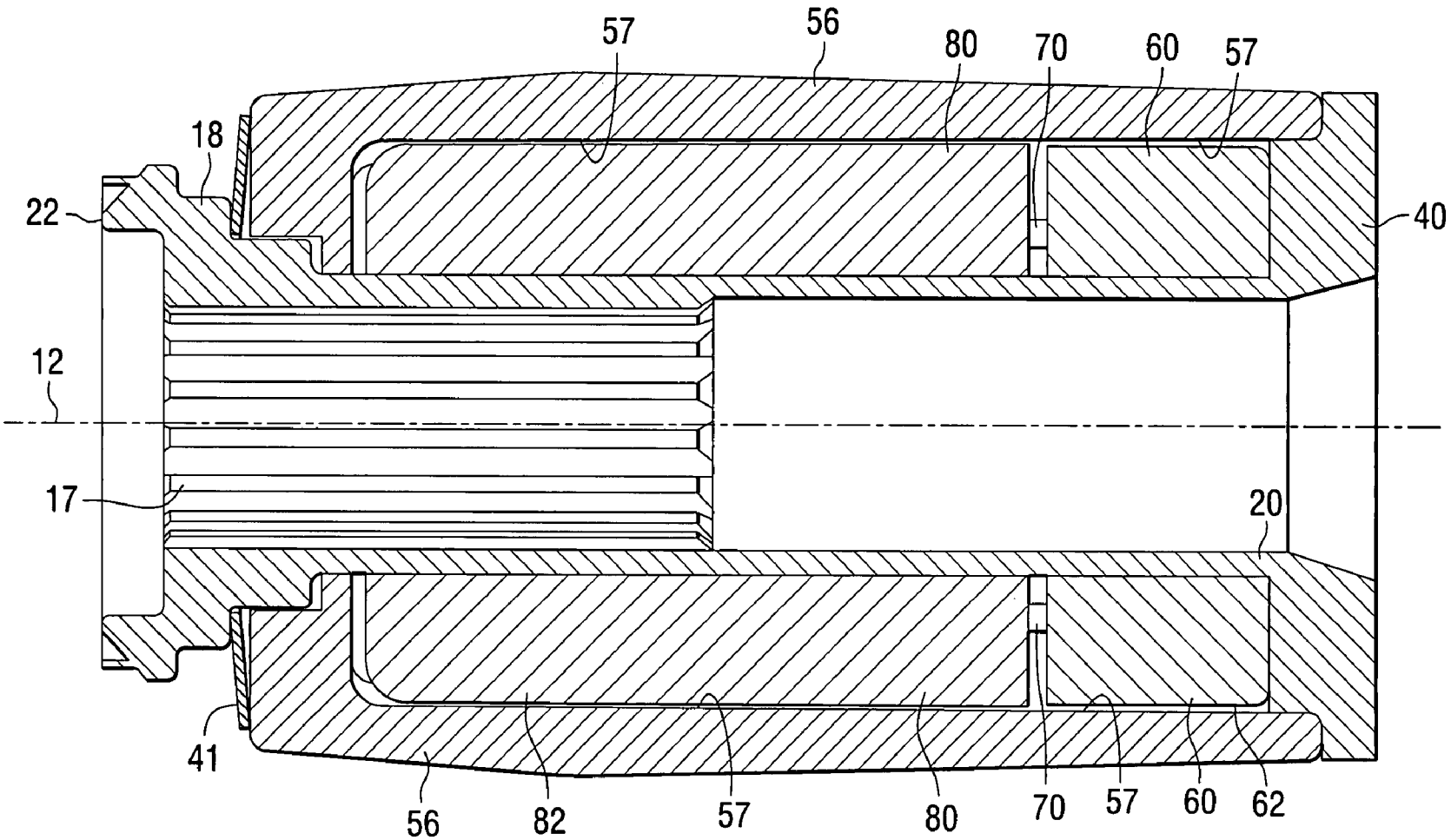
FIG. 3 is a section view of the preferred embodiment of the present invention illustrated in FIG. 2.

FIG. 3 is a section view of the present invention showing the components of FIG. 2 assembled together. In FIG. 3, the spline teeth 17 formed within the inner cylindrical surface of the adapter 18 are shown. As described above, these spline teeth are shaped to receive the spline teeth 14 of the propulsor shaft 10 in meshing relation therein. As a result, the adapter 18 rotates in synchrony with the propulsor shaft 10. The washer 40 and spring 41 are illustrated in association with the inner hub 56, the adapter 18, a connector mechanism 60 and the first and second torque transfer mechanisms, 70 and 80, respectively. Several characteristics of the preferred embodiment of the present invention can be seen in FIG. 3. First, the connector mechanism 60 has an outer surface 62 which is illustrated in clearance relation within the inner surface 57 of the inner hub 56. In a particularly preferred embodiment of the present invention, no torque is transferred between the connector mechanism 60 and the inner hub 56. The first torque transfer mechanism 70, represented by rods in FIG. 3, is shown between and connected to the connector mechanism 60 and the second torque transfer mechanism 80. The outer surface 82 of the second torque transfer mechanism 80 is shown in contact with the inner surface 57 of the inner hub 56.

At torque magnitudes less than the preselected threshold described above, all torque is transferred through the adapter 18 to the connector mechanism 60, through the first torque transfer mechanism 70, and through the second torque transfer mechanism 80 and its outer surface 82 to the inner hub 56. In a particularly preferred embodiment of the present invention, virtually no torque is transferred directly between the connector mechanism 60 and the inner hub 56. In addition, at torque magnitudes less than the threshold magnitude, virtually no torque is transferred directly from the adapter 18 to the second torque transfer mechanism 80. In other words, the configuration of the second plurality of protrusions 92 and the second plurality of grooves 102 does not provide direct torque transfer between the adapter 18 and the second torque transfer mechanism 80. At torque values less than the preselected threshold, virtually all torque is transferred through the connector mechanism 60.

Figure 4:
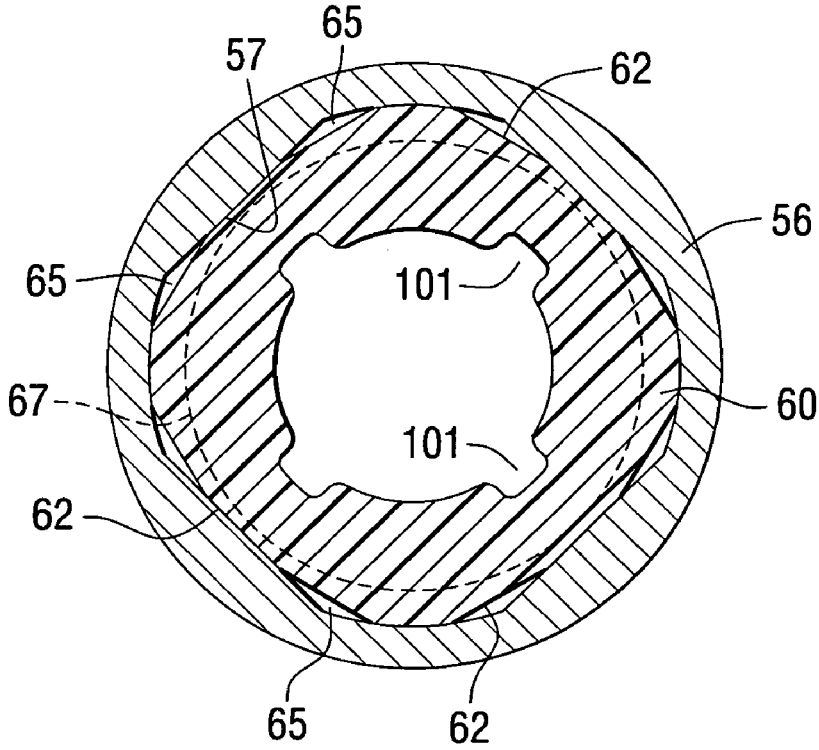
FIG. 4 is a section view taken through a connector mechanism of the present invention.
Figure 5:
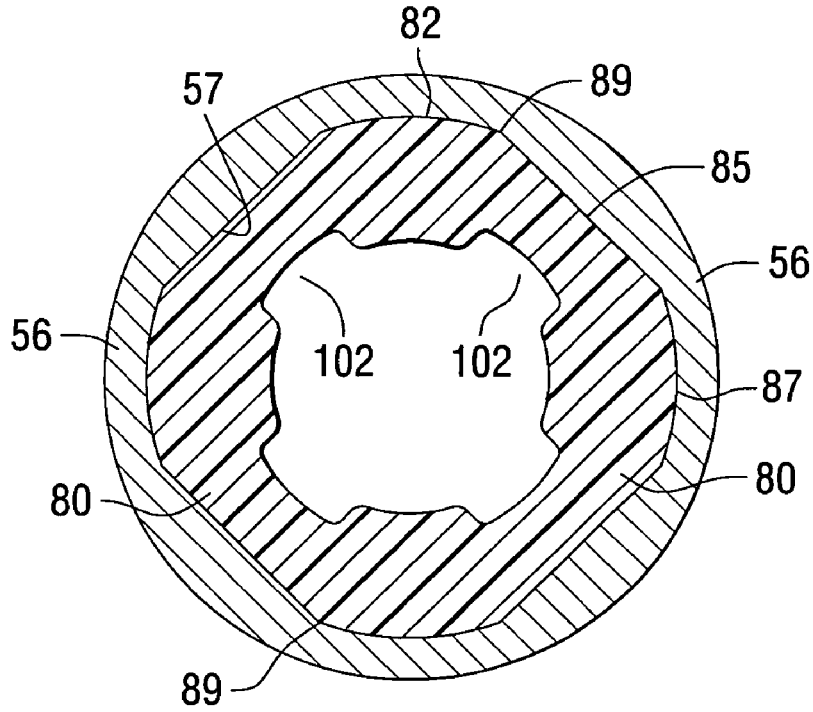
FIG. 5 is a section view taken through a second torque transfer mechanism of a preferred embodiment of the present invention.

FIG. 4 is an assembly section view taken through the connector mechanism 60. FIG. 5 is a section view taken through the second torque transfer mechanism 80. In FIG. 4, the relationship between the outer surface 62 of the connector mechanism 60 and the inner surface 57 of the inner hub 56 is illustrated to show that gaps 65 exist therebetween. Dashed line circle 67 is provided in FIG. 4 to illustrate that the preferred embodiment of the present invention is intended to work satisfactorily even if the outer surface 62 of the connector mechanism 60 is sufficiently reduced to eliminate all physical contact between it and the inner surface 57 of the inner hub 56. In other words, torque transfer between the outer surface 62 of the connector mechanism 60 and the inner surface 57 of the inner hub 56 is not required and, in most embodiments of the present invention, is avoided. Although some embodiments of the present invention incorporate slight physical contact between the outer surface 62 of the connector mechanism 60 and the inner surface 57 of the inner hub 56, it should be understood that this physical contact is incidental and not intended to transmit any substantial degree of torque between the connector mechanism 60 and the inner hub 56. In FIG. 5, the relationship between the outer surface 82 of the second torque transfer mechanism 80 and the inner surface 57 of the inner hub 56 is significantly different than the corresponding relationship described in conjunction with FIG. 4. The outer surface 82 is shaped to conform closely to the inner surface 57 to assure torque transfer between the second torque transfer mechanism 80 and the inner hub 56. The shapes of these contacting surfaces comprise flat portions 85 and curved portions 87. As a result, edges 89 are created. The shapes of the outer surface 82 and the inner surface 57 result in reliable torque transfer capabilities between the second torque transfer mechanism 80 and the inner hub 56.

With reference to FIGS. 4 and 5, it can be seen that the first plurality of grooves 101 are smaller, in a circumferential direction, than the second plurality of grooves 102. Since the first and second pluralities of protrusions, 91 and 92, of the adapter 18 are essentially the same width, the increased width of the second plurality of grooves 102 allows clearance between the second plurality of protrusions 92 and the second plurality of grooves 102. This clearance, in turn, permits relative rotation between the adapter 18 and the second torque transfer mechanism 80.

Figure 6:
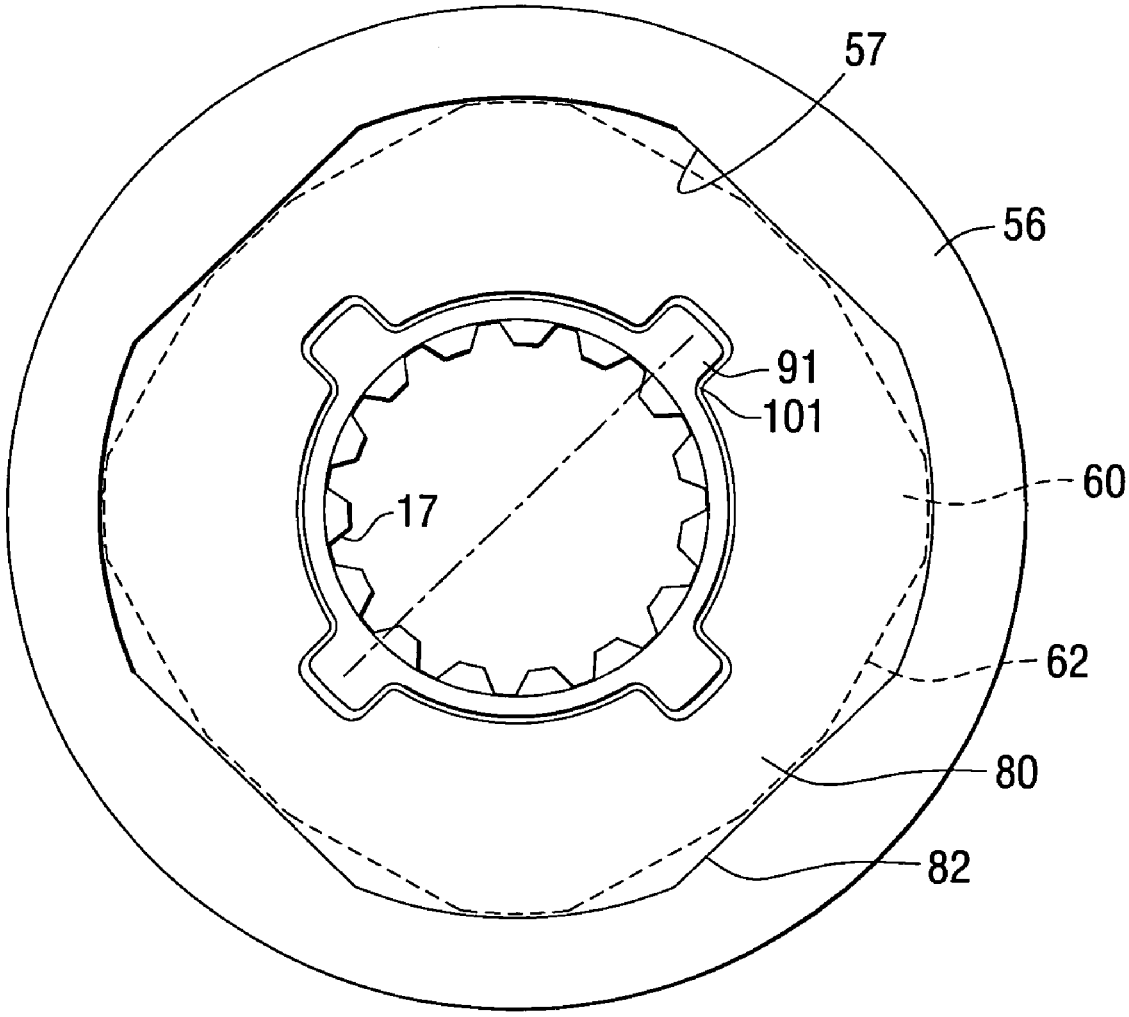
FIG. 6 is a composite view showing both the connector mechanism and second torque transfer mechanism of a preferred embodiment of the present invention in conjunction with an inner hub and an adapter member.

FIG. 6 is a composite view showing both the connector mechanism 60 and the second torque transfer mechanism 80 in conjunction with the inner hub 56. The outer surface 62 of the connector mechanism 60 is represented by dashed lines in FIG. 6. It can be seen that the outer surface 82 of the second torque transfer mechanism 80 conforms precisely with the inner surface 57 of the inner hub 56 while the outer surface 62 of the connector mechanism 60 is disposed in only slight contact with the inner surface 57 and, as a result, the connector mechanism 60 is not intended to transfer any substantial degree of torque to the inner surface 57. In fact, as described above in conjunction with FIG. 4, the outer surface 62 of the connector mechanism 60 could be reduced in size to eliminate all contact between it and the inner surface 57 of the inner hub 56.

Figure 7:
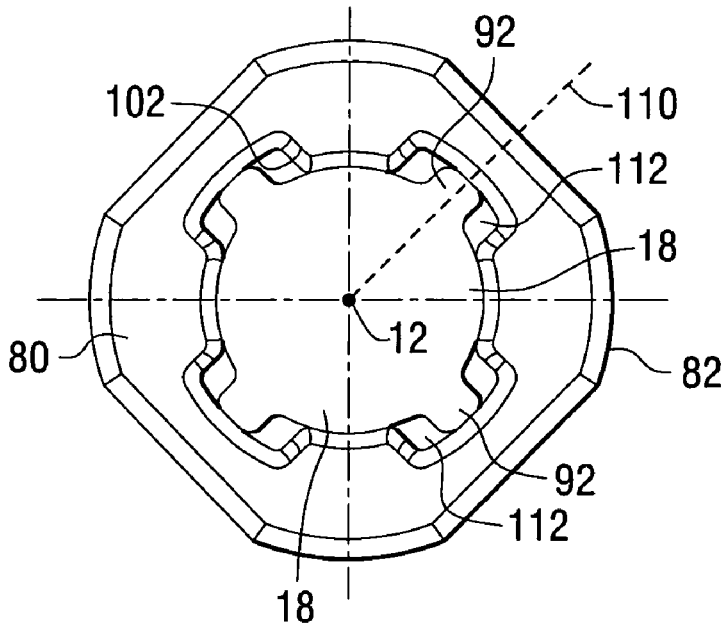
FIGS. 7 and 8 show the relative rotational movement between an adapter and a second torque transfer mechanism in a preferred embodiment of the present invention.
Figure 8:
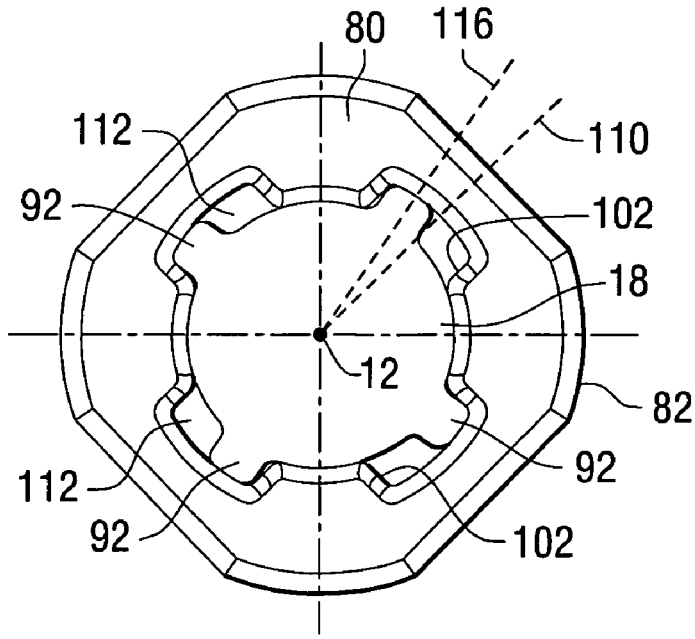

FIGS. 7 and 8 are provided to show the relationship between the second plurality of protrusions 92 and the second plurality of grooves 102 that allows relative rotation to occur between the adapter 18 and the second torque transfer mechanism 80. In FIG. 7, each of the second plurality of protrusions 92 is disposed at a central portion of a respective one of the second plurality of grooves 102. Dashed line 110 represents this central alignment of each of the second plurality of protrusions 92 within an associated one of the second plurality of grooves 102. As identified by reference numerals 112, clearance exists between the side surfaces of each of the second plurality of protrusions 92 and the corresponding side surfaces of each of the second plurality of grooves 102. In FIG. 8, the adapter 18 has rotated about axis 12 relative to the second torque transfer mechanism 80. The center of each of the second plurality of protrusions 92 has moved to the position indicated by dashed line 116. The angular difference between dashed lines 110 and 116 represents the relative rotational magnitude that occurs between the adapter 18 and the second torque transfer mechanism 80. The size of the second plurality of grooves 102 relative to the size of the second plurality of protrusions 92 permits this relative rotation.

Figure 9:
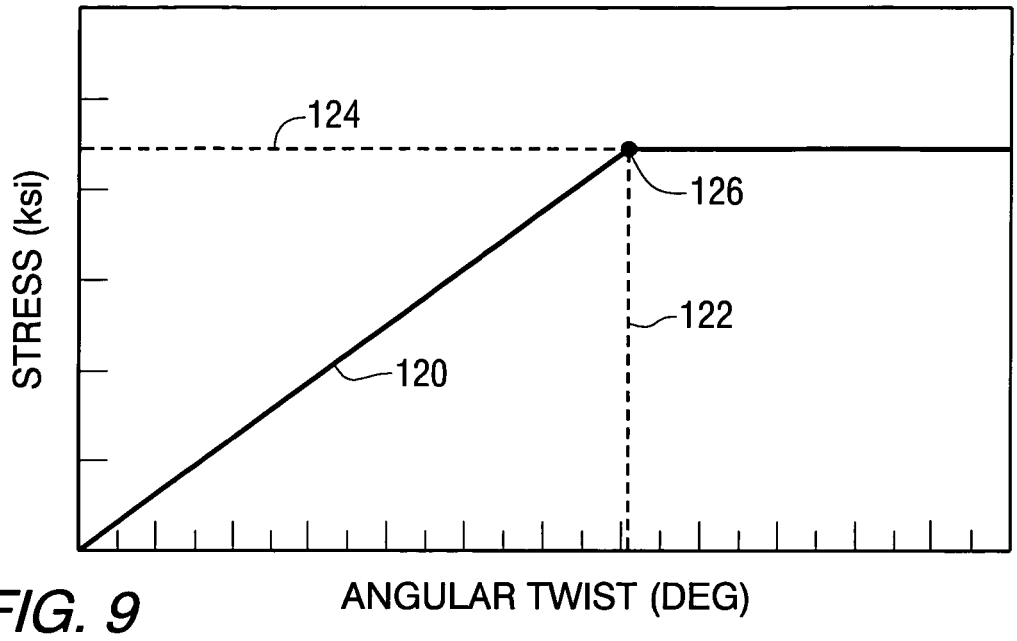
FIG. 9 is a graphical representation of the stress versus twist experienced by the first torque transfer mechanism of a preferred embodiment of the present invention.

FIG. 9 is a graphical representation showing the magnitude of stress on the first torque transfer mechanism 70 as a function of the angular twist between the propulsor shaft 10 and the propulsor 50. Line 120 represents the increasing magnitude of stress on the first torque transfer mechanism 70 as the propulsor shaft 10 rotates relative to the propulsor 50. When the second plurality of protrusions 92 moves into contact with the walls of the second plurality of grooves 102, as represented by dashed line 122, no further stress is caused in the first torque transfer mechanism 70. This maximum magnitude of stress is represented by dashed line 124 in FIG. 9. For magnitudes of angular twist above dashed line 122, no additional stress is caused in the first torque transfer mechanism 70 because of the coordinated movement of the connector mechanism and the second torque transfer mechanism 80 beyond point 126.

Figure 10:
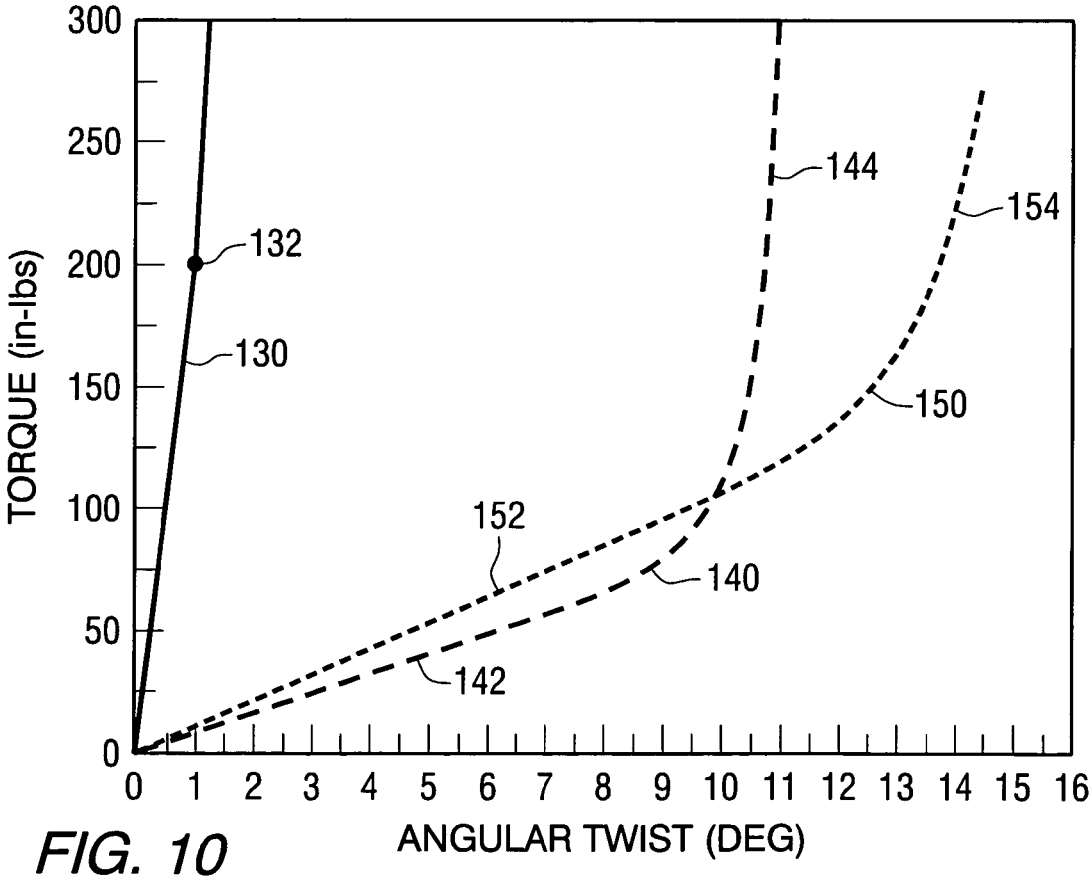
FIG. 10 is a graphical representation of the torque versus twist relationships of two known types of torque transfer mechanisms illustrated in conjunction with the relationship provided by a preferred embodiment of the present invention.

FIG. 10 is a graphical representation of the relationships between torque transferred through the system and the angular twist between the propulsor shaft 10 and the propulsor 50. Line 130 represents the relationship between torque and twist which is typical in torque transfer systems such as those described in U.S. Pat. Nos. 5,244,348 and 5,322,416, which are described above. Although these types of propeller sleeve mechanisms can be constructed to exhibit more than one rate of deflection as a function of torque, they are generally stiff and not significantly compliant. As a result, it is difficult to reduce propeller rattle in certain applications. Dashed line 140 represents the relationship between torque and twist for a device such as that described in U.S. Pat. No. 6,478,543. A device of this type is significantly more compliant at low torque magnitudes than the device represented by line 130. The device described in U.S. Pat. No. 6,478,543 also exhibits a significant difference in compliance for different magnitudes of torque, as represented by the generally compliant region 142 of curve 140 and the much stiffer region 144. The two compliance rates exist below and above a torque magnitude of approximately 80 to 100 inch pounds. The torque versus twist relationship provided by a preferred embodiment of the present invention is represented by dashed line 150 in FIG. 10. At relatively low magnitudes of torque, such as below approximately fifteen foot pounds, the preferred embodiment of the present invention exhibits a compliance characteristic that is stiffer than that represented by dashed line 140. This portion of line 150 is identified by reference numeral 152. At higher magnitudes of torque, such as that represented by reference numeral 154, the stiffness of the device increases to be able to withstand higher magnitudes of torque.

With reference to FIGS. 2–10, a preferred embodiment of the present invention provides several distinct advantages in comparison to devices known to those skilled in the art. One significant advantage of the preferred embodiment of the present invention is its capability of being tailored to suit many different applications and propulsor types. The diameter of the rods 74 can be selected to create a compliance characteristic at lower torque magnitudes which suits the particular engine configuration used in the marine propulsion system and the type of propeller and its pitch selection. Since the connector mechanism is particularly shaped to transfer virtually no torque directly to the inner surface 57 of the inner hub 56, where an abrasion to its outer surface is significantly minimized or eliminated. It can be seen that the axial length L1 of the second torque transfer mechanism 80 is significantly longer than the axial length L2 of the connector mechanism 60. Since the connector mechanism 60 is subjected only to the torque that is transferred through the first torque transfer mechanism 70, it need not withstand significant magnitudes of torque. The second torque transfer mechanism 80, on the other hand, is intended to transfer most of the torque at higher magnitudes of torque between the propulsor shaft 10 and the propulsor 50. The selection of a polymer, such as a polyetheretherketone with 30% carbon fibers, significantly increases the strength of the second torque transfer mechanism 80. This increases its durability and its ability to transfer higher magnitudes of torque than could otherwise be satisfactorily transferred using systems known to those skilled in the art of marine propellers.

Although the present invention has been described with particular specificity and illustrated to show a particularly preferred embodiment, it should be understood that alternative embodiments are also within its scope. For example, although the preferred embodiment of the present invention is made of polyetheretherketone with 30% carbon fibers, alternative polymers can also be used. In addition, although the connector mechanism 60 has been described in terms of having an outer surface 62 which transfers essentially no torque directly to the inner surface 57 of the inner hub 56, it should be understood that small magnitudes of torque transfer therebetween are also within the scope of the present invention. Furthermore, although the outer surface 62 of the connector mechanism 60 has been described in terms of a multi-faceted surface or, alternatively, a circular surface, it should be understood that the specific shape and size of the outer surface 62 is not limiting to the present invention. It can also be seen that, although the connector mechanism 60 is shown in front of the second torque transfer mechanism 80, these positions can be reversed in alternative embodiments of the present invention.

We claim:

1. A torque transmitting device for a marine propulsion system, comprising:

an adapter shaped to be attached in torque transmitting relation with a propulsor shaft of said marine propulsion system for rotation about an axis of said propulsor shaft;

a connector mechanism attached in torque transmitting relation with said adapter for rotation in synchrony with said adapter about said axis;

a first torque transfer mechanism having a first end and a second end, said first end of said first torque transfer mechanism being attached to said connector mechanism for rotation in synchrony with said connector mechanism about said axis;

a second torque transfer mechanism which is rotatable relative to said adapter by a preselected angular magnitude, said second end of said first torque transfer mechanism being attached to said second torque transfer mechanism, said second torque transfer mechanism being attachable to a propulsor for rotation in synchrony with said propulsor about said axis, a radially outer surface of said connector mechanism being disposed generally in non torque transmitting relation with said propulsor, a radially outer surface of said connector mechanism being disposed in noncontact association with said propulsor.

2. The torque transmitting device of claim 1, wherein:

said adapter has a first set of spline teeth shaped to be disposed in meshing relation with a second set of spline teeth of said propulsor shaft to attach said adapter in torque transmitting relation with said propulsor shaft.

3. The torque transmitting device of claim 1, further comprising:

a first plurality of protrusions extending radially outwardly from said adapter; and a first plurality of grooves formed in said connector mechanism, each of said first plurality of grooves being shaped to receive an associated one of said first plurality of protrusions in torque transmitting relation therein.

4. The torque transmitting device of claim 3, further comprising:

a second plurality of protrusions extending radially outwardly from said adapter; and a second plurality of grooves formed in said second torque transfer mechanism, each of said second plurality of grooves being shaped to receive an associated one of said second plurality of protrusions with a clearance therebetween to permit relative movement between said adapter and said second torque transfer mechanism.

5. The torque transmitting device of claim 4, wherein:

said first and second pluralities of protrusions are aligned with each other.

6. The torque transmitting device of claim 4, wherein:

each of said second plurality of grooves formed in said second torque transfer mechanism is shorter than the axial length of said second torque transfer mechanism.

7. The torque transmitting device of claim 4, wherein:

each of said second plurality of protrusions is contiguous with an associated one of said first plurality of protrusions.

8. The torque transmitting device of claim 1, wherein:

said first torque transfer mechanism has a first characteristic of compliance in response to a force exerted on said first torque transfer mechanism as a result of torque exerted between said propulsor shaft and said propulsor; and said second torque transfer mechanism has a second characteristic of compliance in response to force exerted on said second torque transfer mechanism as a result of torque exerted between said propulsor shaft and said propulsor.

9. The torque transmitting device of claim 8, wherein:

said first characteristic is more compliant than said second characteristic.

10. The torque transmitting device of claim 1, wherein:

said first torque transfer mechanism comprises a plurality of metal rods connected between said connector mechanism and said second torque transfer mechanism.

11. The torque transmitting device of claim 1, wherein:

said second torque transfer mechanism is made of a material comprising polyetheretherketone.

12. The torque transmitting device of claim 1, wherein:

all torque, between said propulsor shaft and said propulsor, below a first predetermined magnitude is transmitted through said first torque transfer mechanism.

13. The torque transmitting device of claim 1, wherein:

said second torque transfer mechanism is disposed at a position which is closer to a distal end of said propulsor shaft than said connector mechanism.

14. The torque transmitting device of claim 1, wherein:

said second torque transfer mechanism has a first axial length and said connector mechanism has a second axial length, said first axial length being longer than said second axial length, said first and second axial lengths being measured in a direction parallel to said axis.

15. The torque transmitting device of claim 14, wherein:

said first axial length is twice as long as said second axial length.

16. The torque transmitting device of claim 1, wherein:

said first torque transfer mechanism comprises a plurality of titanium rods connected between said connector mechanism and said second torque transfer mechanism.

17. A torque transmitting device for a marine propulsion system, comprising:

an adapter shaped to be attached in torque transmitting relation with a propulsor shaft of said marine propulsion system for rotation about an axis of said propulsor shaft in synchrony with said propulsor shaft, said adapter having a first set of spline teeth shaped to be disposed in meshing relation with a second set of spline teeth of said propulsor shaft to attach said adapter in torque transmitting relation with said propulsor shaft;

a connector mechanism attached in torque transmitting relation with said adapter for rotation in synchrony with said adapter about said axis;

a first torque transfer mechanism having a first end and a second end, said first end of said first torque transfer mechanism being attached to said connector mechanism for rotation in synchrony with said connector mechanism about said axis;

a second torque transfer mechanism which is rotatable relative to said adapter by a preselected angular magnitude, said second end of said first torque transfer mechanism being attached to said second torque transfer mechanism, said second torque transfer mechanism being attachable to a propulsor for rotation in synchrony with said propulsor about said axis, all torque, between said propulsor shaft and said propulsor, below a first predetermined magnitude is transmitted through said first torque transfer mechanism, said second torque transfer mechanism being disposed at a position which is closer to a distal end of said propulsor shaft than said connector mechanism.

18. The torque transmitting device of claim 17, further comprising:

a first plurality of protrusions extending radially outwardly from said adapter;

a first plurality of grooves formed in said connector mechanism, each of said first plurality of grooves being shaped to receive an associated one of said first plurality of protrusions in torque transmitting relation therein;

a second plurality of protrusions extending radially outwardly from said adapter; and a second plurality of grooves formed in said second torque transfer mechanism, each of said second plurality of grooves being shaped to receive an associated one of said second plurality of protrusions with a clearance therebetween to permit relative movement between said adapter and said second torque transfer mechanism.

19. The torque transmitting device of claim 18, wherein: each of said second plurality of protrusions is contiguous with an associated one of said first plurality of protrusions.

20. The torque transmitting device of claim 18, wherein: said first torque transfer mechanism has a first characteristic of compliance in response to a force exerted on said first torque transfer mechanism as a result of torque exerted between said propulsor shaft and said propulsor; and said second torque transfer mechanism has a second characteristic of compliance in response to force exerted on said second torque transfer mechanism as a result of torque exerted between said propulsor shaft and said propulsor.

21. The torque transmitting device of claim 20, wherein: said first characteristic is more compliant than said second characteristic.

22. The torque transmitting device of claim 17, wherein: said first torque transfer mechanism comprises a plurality of metal rods connected between said connector mechanism and said second torque transfer mechanism.

23. The torque transmitting device of claim 17, wherein: said second torque transfer mechanism is made of a material comprising polyetheretherketone.

24. The torque transmitting device of claim 17, wherein: a radially outer surface of said connector mechanism is disposed in noncontact association with said propulsor.

25. The torque transmitting device of claim 17, wherein: all torque, between said propulsor shaft and said propulsor, below a first predetermined magnitude is transmitted through said connector mechanism and through first torque transfer mechanism.

26. The torque transmitting device of claim 17, wherein: said first torque transfer mechanism comprises a plurality of titanium rods connected between said connector mechanism and said second torque transfer mechanism.

27. A torque transmitting device for a marine propulsion system, comprising:

an adapter shaped to be attached in torque transmitting relation with a propulsor shaft of said marine propulsion system for rotation about an axis of said propulsor shaft in synchrony with said propulsor shaft, said adapter having a first set of spline teeth shaped to be disposed in meshing relation with a second set of spline teeth of said propulsor shaft to attach said adapter in torque transmitting relation with said propulsor shaft;

a connector mechanism attached in torque transmitting relation with said adapter for rotation in synchrony with said adapter about said axis;

a first torque transfer mechanism having a first end and a second end, said first end of said first torque transfer mechanism being attached to said connector mechanism for rotation in synchrony with said connector mechanism about said axis;

a second torque transfer mechanism which is rotatable relative to said adapter by a preselected angular magnitude, said second end of said first torque transfer mechanism being attached to said second torque transfer mechanism, said second torque transfer mechanism being attachable to a propulsor for rotation in synchrony with said propulsor about said axis, said connector mechanism being disposed in non torque transmitting relation with said propulsor, said second torque transfer mechanism being disposed at a position which is closer to a distal end of said propulsor shaft than said connector mechanism;

a first plurality of protrusions extending radially outwardly from said adapter;

a first plurality of grooves formed in said connector mechanism, each of said first plurality of grooves being shaped to receive an associated one of said first plurality of protrusions in torque transmitting relation therein;

a second plurality of protrusions extending radially outwardly from said adapter; and a second plurality of grooves formed in said second torque transfer mechanism, each of said second plurality of grooves being shaped to receive an associated one of said second plurality of protrusions with a clearance therebetween to permit relative movement between said adapter and said second torque transfer mechanism.

28. The torque transmitting device of claim 27, wherein: said first torque transfer mechanism has a first characteristic of compliance in response to a force exerted on said first torque transfer mechanism as a result of torque exerted between said propulsor shaft and said propulsor; and said second torque transfer mechanism has a second characteristic of compliance in response to force exerted on said second torque transfer mechanism as a result of torque exerted between said propulsor shaft and said propulsor, said first characteristic being more compliant than said second characteristic.

29. The torque transmitting device of claim 28, wherein: said first torque transfer mechanism comprises a plurality of metal rods connected between said connector mechanism and said second torque transfer mechanism.

30. The torque transmitting device of claim 29, wherein: said second torque transfer mechanism is made of a material comprising polyetheretherketone.

31. The torque transmitting device of claim 28, wherein: a radially outer surface of said connector mechanism is disposed in noncontact association with said propulsor.

32. The torque transmitting device of claim 31, wherein: all torque, between said propulsor shaft and said propulsor, below a first predetermined magnitude is transmitted through said first torque transfer mechanism.

33. The torque transmitting device of claim 32, wherein: said first torque transfer mechanism comprises a plurality of titanium rods connected between said connector mechanism and said second torque transfer mechanism.

* * * * *